United States Patent [19]

Tabin

[11] 4,227,794

[45] Oct. 14, 1980

[54] PHOTOGRAPHIC FILM PROCESSING APPARATUS

[76] Inventor: Frank Tabin, 1108 Bechtel St., Monaca, Pa. 15061

[21] Appl. No.: 66,067

[22] Filed: Aug. 13, 1979

[51] Int. Cl.[3] ..... G03D 3/04

[52] U.S. Cl. ..... 354/299; 354/330; 354/331; 366/208

[58] Field of Search ..... 354/299, 323, 329, 330, 354/331; 366/208, 213, 220

[56] References Cited

U.S. PATENT DOCUMENTS

| | | | |
|---|---|---|---|
| 1,983,164 | 12/1934 | Bush | 366/208 |
| 2,947,236 | 8/1960 | Siegel | 354/330 |
| 3,682,080 | 8/1972 | Merz | 366/208 |
| 3,703,860 | 11/1972 | Wilkinson | 354/299 |
| 3,705,544 | 12/1972 | Ratowsky | 354/329 |
| 3,982,259 | 9/1976 | Baerle | 354/323 |
| 4,035,818 | 7/1977 | King | 354/331 |

*Primary Examiner*—Michael L. Gellner
*Assistant Examiner*—Alan Mathews
*Attorney, Agent, or Firm*—Webb, Burden, Robinson & Webb

[57] ABSTRACT

An apparatus for use in the development of photographic film comprising a tank for holding a substantially constant temperature bath. Two axles carrying wheels or rollers thereon are journaled in the side walls of the tank. The first axle and thereby wheels or rollers attached thereto is driven by a motor. The second axle has a plurality of positions relative to the first where it may be journaled. Thus the apparatus may be adapted to receive a plurality of sizes of drum processors used in the processing of photographic film by variously positioning the second axle. Thus the drum processor resting on the wheels is rotated through the bath as the driven axle is turned to thus maintain the processor and its contents near the bath temperature.

10 Claims, 1 Drawing Figure

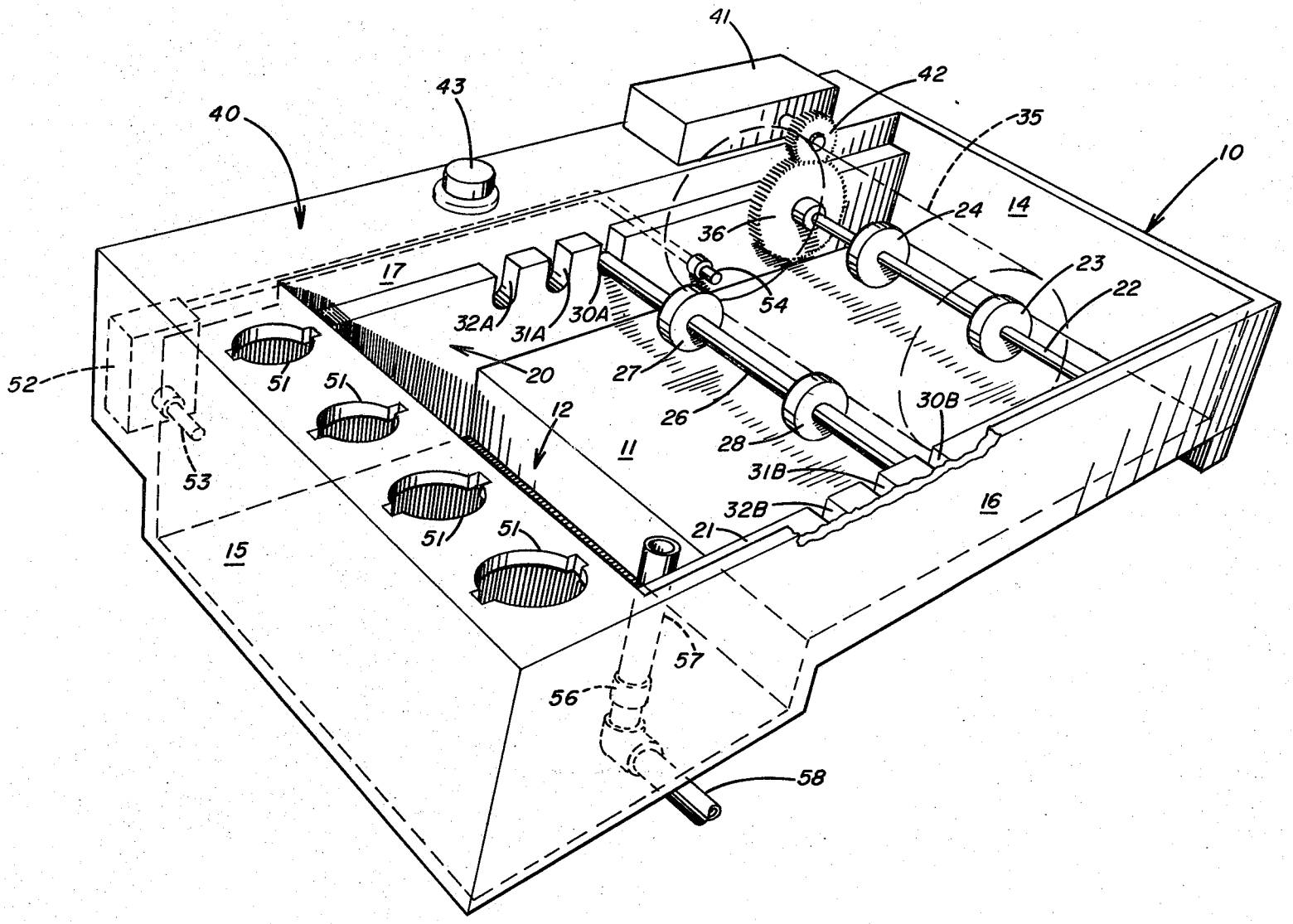
10
22
23
35
14
24
42
16
30B
41
54
36
31B
32B
28
21
58
26
27
57
11
30A
56
12
31A
20
32A
51
43
51
17
51
51
40
15
53
52

PHOTOGRAPHIC FILM PROCESSING APPARATUS

BACKGROUND

Good darkroom practice necessitates that photographic solutions (developer, stop bath, fixing bath and wash) be maintained at the manufacturer's recommended temperatures. It is recommended that all solutions be kept at the same temperature including the water for the stop bath and wash. Differences in temperature can cause the film emulsion to wrinkle and break-up. Also, if a developer solution is too cool, then one or more of the chemicals may become partially inactive or slow acting. If the developer is too warm, then one or more of the chemicals will become too active. The established method of bringing the developer solutions to the correct temperature is to place them in a water bath wherein the water is at the correct temperature. The temperature of the water can be adjusted by mixing hot and cold tap water with the use of a thermometer. More sophisticated water baths are available which have a heating element immersed therein with an electronic temperature control.

It is common practice today to develop photographic film in a daylight processing drum into which the exposed photographic film is loaded prior to processing. The drums are designed so that solutions may be poured into and out of them without light entering the interior of the drum. The developing chemicals are poured into the drum and the drum is rotated to bathe the film in the developing chemicals. During the time of processing which may be only several minutes, the temperature of the solutions in the drum tends to change. It is desirable to be able to maintain the temperature of the drum and its contents substantially uniform by rotating the drum through a constant temperature bath.

SUMMARY OF THE INVENTION

Briefly according to this invention, there is provided an apparatus for use in the development of photographic film. The apparatus comprises a tank or tray for holding water at a selected temperature. Preferably the tank comprises a shallow tray and along one edge thereof a deeper well. Typically the tray will be about three and one-half inches deep and the well will be about six inches deep. A first axle with at least two wheels thereon having equal diameter is journaled across the tank near one edge. A gear or sprocket is fixed to the first axle so that it may be driven by a motor mounted to the side of the tank. A second and movable axle with at least two wheels thereon of equal diameter is positionable in a plurality of journaling positions such that the first and second axles may be spaced at a plurality of distances from each other and parallel to each other. The second axle is an idler, that is, it is not directly motor driven. Where the tank has multiple depths, (i.e., a tray portion and a deeper well portion) the axles are arranged above the tray portion.

Preferably the wheels on all axles are of equal diameter and are comprised of a resilient material such as hard rubber. Preferably the wheels snugly engage the axle passing through a hole at the center thereof but can be moved along the axle just by hand pressure. By selecting the optimum spacing between axles and adjusting the wheels along the axles the wheels may be adapted to receive a process drum of almost any configuration now available with the lowermost portion of the drum arranged to be rotated through the bath. In other words, at least a portion of the lowermost part of the drum is submerged in the bath. According to the preferred embodiment of this invention, a cover is provided over the deeper well portion of the tank with provisions to secure containers for developing solutions in the well surrounded by the bath. In yet another preferred embodiment, there is an overflow pipe positioned in the well portion of the tank which may be turned out of a threaded drain port. It is a further preferred embodiment according to this invention that the electrical power to the motor for driving the driven axle is controlled by a dimmer switch, for example of the rheostat type. In another preferred embodiment of this invention, a circulation pump draws the bath water from the well, adjusts the temperature thereof if need be, and forces it back into the bath between the axles.

THE DRAWING

Further features and other objects and advantages of this invention will become clear from the following detailed description made with reference to the drawing which is a perspective view of a photographic film processing apparatus according to this invention.

DESCRIPTION OF THE PREFERRED EMBODIMENTS

Referring now to the drawing, there is shown a tank 10 having a shallow tray portion 11 and a deeper well portion 12. Preferably, the tray is approximately three inches deep and the well portion is approximately six inches deep. As shown in the drawing, the endwalls 14 and 15 appear shorter than the side walls 16 and 17. However, a preferred size for the tank is approximately 25 inches along ends 14 and 15 and 20 inches along sides 16 and 17. The length of the tray portion of the tank along the side 16 is preferably approximate 15 inches and the width of the well portion of the tank along side 16 is preferably 5 inches. It should be understood that the dimensions given are by way of a preferred example and may be suitably altered without departing from the concepts of this invention.

Positioned along the sides 16 and 17 of the tray portion of the tank are axle braces 20 and 21. Journaled in the axle brace is a driven axle 22. Mounted upon the driven axle are wheels 23 and 24 which are preferably comprised of a resilient material such as rubber. The diameter of the wheels should be approximately equal to the depth of the tray and the axle journaled approximately half way between the bottom of the tray and the top of the tray. Thus the axles and wheels will be partially immersed when the tank is filled with bath water.

Spaced from the driven axle 22 is a movable idler axle 26 having wheels 27 and 28 mounted thereon. Preferably the wheels on the idler axle are of the same diameter as the wheels on the driven axle. It is preferred that all four wheels 23, 24, 27 and 28 are of the same diameter and may be moved in the axial direction by hand pressure.

Notches 30A and 30B in axle braces 20 and 21 respectively are arranged to hold the idler axle 26 parallel to the driven axle 22 a spaced distance therefrom. The depth of the notches in the axle braces are such that the driven axle and idler axle lie in approximately the same horizontal plane. Thus the idler axle and wheels supported thereon will be partially immersed when the tank is filled. Additional pairs of notches 31A, 31B and 32A and 32B are provided in the axle braces to provide alternate positions for the idler axle 26 spaced from the driven axle 22. Preferably the notches are positioned so that the axles may be spaced six and one-half, seven and one-quarter and eight inches apart. A processing drum 35 is shown in phantom resting upon the four wheels attached to the axles.

The axle 22 has a driven gear 36 secured thereto. A control box 40 is mounted along one side 17 of the tank. At one end of the control box is mounted an electrical motor and gear box 41. Extending away from the gear box is a drive pinion 42 which engages the driven gear 36. The electrical motor for driving the driven axle 22 is preferably controlled by a dimmer switch (such as a rheostat) adjustable by knobs 43 positioned on the control box 40. Thus for different processes and different size processing drums the speed of drive pinion 42 may be adjusted. Along the end 15 of the tank there is a removable cover 50 over the well. Preferably the cover slidably engages the tank so that its upward movement is restricted once engaged. The cover 50 has a plurality of openings 51 therein for receipt of chemical containers. Note that each opening 51 has two keyways therein. The keyways are arranged to allow chemical containers having keys fixed to the sides thereof to pass therethrough such that upon rotation of the chemical containers they will be held submerged in the well. Otherwise, a partially full container would float up out of the well.

It is a preferred feature according to this invention that a circulation pump 52 be mounted in the control box 40. The circulation pump may have an intake-outlet 53 in the well and an intake-outlet 54 in the tray between the axles. Preferably the intake is in the well and the outlet is between the axles. The pump may comprise a combination circulation pump and temperature control unit. The electronics of the temperature control unit may be as illustrated in U.S. Pat. No. 3,780,263.

In the base of the well is provided a drain port 56 with internal threads. An overflow pipe 57 with external threads is turned into the threads in the drain port. A drain hose 58 is connected to the underside of the drain port 56.

The primary purpose of the overflow pipe is to maintain a proper level of water in the temperature tray so that the processing tubes ride on wheels while skimming over surface of tempered water bath. If water level were not maintained processing tubes would float. Secondary purpose would be to unscrew overflow pipe to empty tray of most of the water when finished using.

The above described apparatus can be used to rotate a plurality of commercially available processing tubes each having a different length, diameter, and in some cases, configuration. For the preferred dimensions set forth, it is possible to accommodate tubes having eight inch diameters and ten inch lengths, eleven inch diameters and fourteen inch lengths, sixteen inch diameters and twenty inch lengths. A protuberance on the outer cylindrical surface of the processor drum can be accommodated by the adjustable spacing of the wheels secured to the axles. Accommodation for the drum diameter is made by selecting the appropriate pair of notches for the idler axle. The above described apparatus will enable the consistent processing of photographic film using a plurality of commercially available daylight process drums or tubes. Typically the chemicals are "presoaked" by placing them in containers which are in turn placed in the well. The processing drum is also "presoaked" by placing upon the wheels and rotated through the bath. If, for example, the temperature of the chemicals in the containers kept in the well is 95° and the presoaked drum is at 95°, the drum will remain near this development temperature during processing. Even with the above described apparatus there may be a loss of about four degrees temperature inside the drum. This variation is acceptable for most development processes considering the type of film involved.

Basically it is an advantage of this invention to provide a processing apparatus for rotating daylight processing drums or tubes or the like through a controlled temperature bath which apparatus is adaptable for different size processing drums or tubes. It is thereby possible to maintain an even chemical temperature during the development period within the drum. It is a further advantage that spill of bath water used to stablize the temperature of the drum is eliminated and the speed of rotation of the drum may be adjusted to provide for the even spreading of chemicals over the prints and film within the drums.

Having thus described my invention with the detail and particularity required by the Patent Laws, what is desired protected by Letters Patent is set forth in the following claims.

I claim:

1. Apparatus for use in the chemical development of photographic film comprising (a) a tank for holding liquid at a selected temperature, (b) means for circulating liquid within the tank controlling the temperature of the liquid, (c) a driven axle with at least two wheels thereon of equal diameter journaled across the tank, (d) a movable idler axle with at least two wheels of equal diameter thereon, (e) a plurality of means for receiving the idler axle arranged in a plurality of journaled positions parallel to the driven axle, (f) means for driving the driven axle to turn the wheels attached thereto, and (g) said wheels movable along the axles without loss of turning engagement, whereby the apparatus may be used to rotate and maintain the temperature of a processing drum placed upon the wheels, the distance between the axles being adjusted to insure adequate immersion of the drum in the liquid.

2. Apparatus according to claim 1 wherein the tank comprises a shallow tray portion defined by a bottom, two side walls and a first endwall and a deeper well portion defined by a bottom, the said side walls and a second endwall, the driven axle being journaled in the side walls near the first endwall and the said receiving means comprising a plurality of slots in the side walls above the tray portion of the tank.

3. Apparatus according to claim 2 wherein a cover with openings therein is positioned above the well portion for receiving and holding containers in the well portion.

4. Apparatus according to claim 2 wherein a circulating pump draws liquid from the well and forces it out into the tray portion wherein the pump includes means for temperature control of the fluid circulated therethrough.

5. Apparatus according to claim 4 wherein a threaded drain port is provided in the bottom of the well portion and an overflow pipe threaded at one end is removably turned into said drain port.

6. Apparatus according to claim 5 wherein the length of the overflow pipe is sized to maintain the water level in the tank such that a processing tube set upon the wheels will skim over the surface of the water bath but will not be sufficiently immersed to float.

7. Apparatus according to claim 1 wherein the driving means is an electrical motor and further comprising a dimmer switch to control the speed of the motor.

8. Apparatus according to claims 1 or 2 wherein the axles are journaled such that when the tank is filled the axles and wheels are immersed.

9. Apparatus according to claims 1 or 2 wherein the driven axle has a toothed wheel mounted thereon of such diameter that the upper portion thereof is not immersed and may be drivingly engaged by the driving means above the liquid bath.

10. Apparatus according to claims 1 or 2 wherein the wheels are comprised of a resilient material.

* * * * *